US007000650B2

(12) United States Patent
Desjardins et al.

(10) Patent No.: US 7,000,650 B2
(45) Date of Patent: Feb. 21, 2006

(54) INSTALLATION FOR FILLING AEROSOL RECEPTACLES

(75) Inventors: Jean Desjardins, Rambouillet (FR); Franck Chamaux, Epernon (FR); Patrick Saint, Saint-Lubin-des-Joncherets (FR)

(73) Assignee: Fillon Investissement, Faverolles (FR)

( * ) Notice: Subject to any disclaimer, the term of this patent is extended or adjusted under 35 U.S.C. 154(b) by 45 days.

(21) Appl. No.: 10/779,774

(22) Filed: Feb. 18, 2004

(65) Prior Publication Data

US 2005/0178465 A1 Aug. 18, 2005

(51) Int. Cl.
*B65B 1/04* (2006.01)

(52) U.S. Cl. ..... 141/20; 141/85

(58) Field of Classification Search ..... 141/2, 141/3, 9, 100, 104, 18, 20, 85, 89–91; 134/166 R–169 C
See application file for complete search history.

(56) References Cited

U.S. PATENT DOCUMENTS 5,377,724 A * 1/1995 Ray ..... 141/20
6,705,359 B1 * 3/2004 Zanellato et al. ..... 141/20

* cited by examiner

*Primary Examiner*—Steven O. Douglas
(74) *Attorney, Agent, or Firm*—Young & Thompson

(57) ABSTRACT

Installation for filling aerosol receptacles comprising a filling station for aerosol receptacles, having a frame, a cylinder whose lower portion is adapted to come into engagement with the valve of an aerosol receptacle. The cylinder is mounted removably on the frame of the filling station, in a position located above the position for receiving the aerosol receptacle, by a jack driving a piston with recipricatory movement in the cylinder to cause liquid contained in the cylinder to pass through the valve in engagement with the cylinder. The filling station extends above a washing and drying station having at least one reservoir of washing fluid provided in its upper portion, extending above the maximum level of the fluid in the reservoir, with elements for suspending the cylinder so as to ensure draining.

20 Claims, 3 Drawing Sheets

INSTALLATION FOR FILLING AEROSOL RECEPTACLES

The present invention relates to an installation for filling aerosol receptacles, of the type comprising a filling station for aerosol receptacles constituted by a frame, a cylinder, such as a beaker, whose lower portion is adapted to come into engagement with the valve of an aerosol receptacle, this cylinder being mounted removably on the frame of the filling station, at a position located above the position for reception of the aerosol receptacle and by a piston driven with reciprocating movement in the cylinder to cause the liquid contained in the cylinder to pass through the valve of the aerosol receptacle in engagement with said cylinder.

An example of such an installation is particularly described in European patent EP-A-0 440 477. The operation of such an installation is as follows: after bringing the cylinder and the aerosol receptacle into engagement, filling of the cylinder proceeds with a fluid which will constitute the filling fluid of the aerosol receptacle. Once this cylinder is filled with a suitable quantity of fluid, the assembly of cylinder and aerosol receptacle is installed in the filling station. A control means for the movement of the piston is then actuated to cause the piston to move from a first position in which it is located above the cylinder, to a second position corresponding to its end of path, in which it extends within the cylinder in a position in which the quantity of liquid to be transferred from the cylinder toward the aerosol receptacle has been transferred. In the course of this descending movement of the piston into the cylinder, the liquid is transferred from the cylinder into the aerosol receptacle by passing through the valve of this latter. The piston is then raised and extracted from the cylinder to permit the removal of the cylinder-receptacle assembly. The receptacle with aerosol is then separated from the cylinder and is ready to use. There can then take place the filling operation of a new aerosol receptacle.

In the case of small scale production in which the nature of the filling fluid is different from one series to another, as is the case when such machines are used for filling paint spray cans, particularly in auto body shops, in the automotive field, it is necessary to clean the cylinder at least with each change of the series. The type of filling fluid used requires most of the time cleaning with solvents that are more or less corrosive and which in any case cannot be freely released into the environment. These solvents moreover produce vapors which should not be breathed.

In present filling installations, the washing station for the cylinders, when it exists, is remote from the filling installation. Transfer of the clean or dirty cylinders must thus take place between the different stations. These transfers lead to the risk of dispersal of the cleaning solvent into the atmosphere, with a loss of time for the operator and a great danger of loss of the cylinder, thereby preventing operation of the machine.

An object of the present invention is thus to provide a filling installation whose design permits reducing on the one hand the risk of loss of constituent elements of the installation, on the other hand the risk of dispersal into the atmosphere of fluids, in particular cleaning fluids, from the machine elements.

Another object of the present invention is to provide a filling installation whose design permits the operator to have at his disposal the elements of the assembly which are necessary for him to operate filling whilst guaranteeing a perfectly certain operative mode of such an operation so as to give the operator a completely ergonomic station.

To this end, the invention has for an object a filling installation for aerosol receptacles, of the type comprising a filling station for aerosol receptacles constituted by at least a frame, a cylinder, such as a beaker, whose lower portion is adapted to come into engagement with the valve of an aerosol receptacle, this cylinder being removably mounted on the frame of the filling station, at a position located above the position for receiving the aerosol receptacle, by a jack driving a piston with recipricatory movement in the cylinder to cause the liquid contained in the cylinder to pass through the valve of the aerosol receptacle in engagement with said cylinder, characterized in that the filling station extends above a washing and drying station of the cylinder(s), this washing station being constituted by at least one reservoir for washing fluid provided in its upper portion, extending above the maximum level of fluid in the reservoir, with means for suspending the cylinder or cylinders to ensure their drying by draining.

Thanks to the arrangement of the washing and drying station, positioned immediately adjacent the filling station, the risk of loss of the constituent elements of the installation or of dispersal of the cleaning solvents from these different elements into the atmosphere, are avoided.

The invention will be better understood from a reading of the following description of embodiments, with reference to the accompanying drawings, in which.

Figure 2:
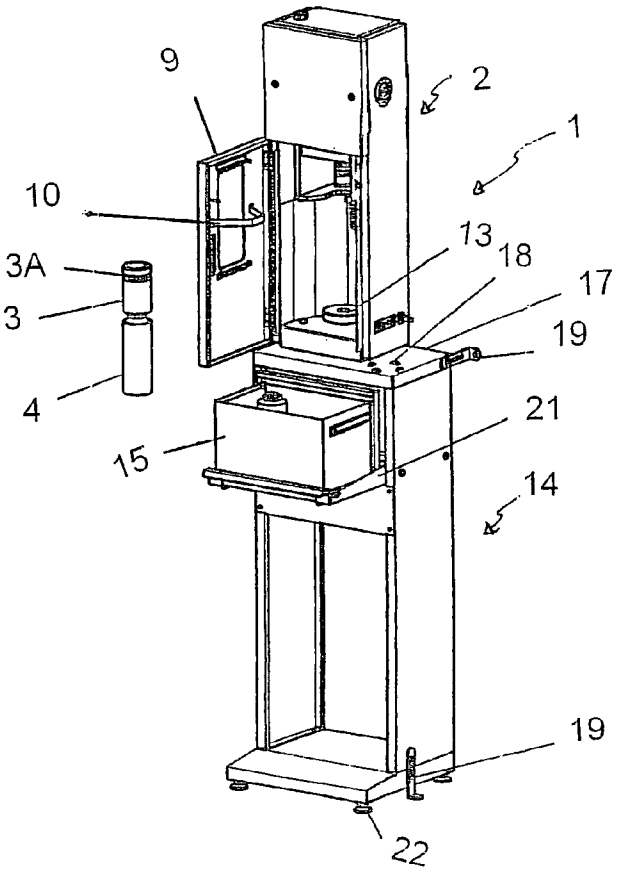
FIG. 2 is a perspective view of a filling installation of the aerosol receptacle according to the invention in which the filling station is shown in the open position of the cabinet constituting the frame of said station and the washing fluid reservoir is in the open position.

As mentioned above, the filling installation 1 for aerosol receptacles 4, according to the invention, comprises on the one hand a filling station 2, on the other hand a washing and drying station 14.

The filling station 2, which serves for filling the aerosol receptacle 4, is constituted by a frame 5, by at least one cylinder 3, such as a beaker, whose lower portion is adapted to come into engagement with the valve of an aerosol receptacle 4 to be filled, this cylinder 3 being mounted removably on the frame 5 of the filling station 2, at a position 6 located above the position 7 for the aerosol receptacle 4, and by a piston 8 driven, with the help of a jack, with a recipricatory movement in the cylinder 3 to cause the liquid contained in the cylinder 3 to pass through the valve of the aerosol receptacle 4 in engagement with said cylinder 3. The actuating means of this piston 8 and of the associated jack are disposed in the upper portion of the frame 5 of the filling station 2. They will not be described in greater detail because they are well known to those skilled in the art.

In the illustrated examples, this frame 5 of the filling station 2 thus has the form of a cabinet receiving the cylinder 3 and aerosol receptacle 4 in the suspended condition of the cylinder 3 within the cabinet. This cabinet is provided with a front door 9 having, on its internal surface, a projection 7 holding the cylinder 3 applied against the suspension means of the cabinet in the closed position of the door 9 and centering the cylinder 3 relative to the piston 8. This projection 10 effects, during closing of the door, the centering of the cylinder 3 relative to the piston 8 and this no matter what the diameter of the aerosol receptacle 4. Thus it is impossible to damage the piston when this latter comes into contact with the cylinder 3. As this projection 10 is carried by the door, it does not hinder the removal of the cylinder 3 and of the receptacle 4 after opening the door. It is to be noted that the assembly of the frame is provided with detectors which permit the operation of the apparatus only when the door is closed. The suspension means of the cylinder 3 in the frame 5 of the filling station 2 are themselves constituted by a U 12 whose base is coupled to the rear surface of the cabinet and by a suspension plate 11 enclosing one surface of the U 12. This suspension plate 11 comprises a U shaped recess which has legs which are inserted in a circumferential external throat 3A of the cylinder 3 to hold the cylinder 3 in suspended condition. The piston 8, adapted to be driven with a rising and falling movement within the cylinder, is itself removably mounted on the rod of the jack to facilitate cleaning. Similarly, the lower portion 3B of the cylinder 3, adapted to come into engagement with the valve of an aerosol receptacle 4, is made in the form of a disassembleable member to permit, as a function of the type of aerosol receptacle 4 to be filled, adapting the connection means of the cylinder 3 to this aerosol receptacle 4. The removable piece 3B comprises a smooth tapering or else a screw thread to be adapted to different types of valves of aerosol receptacle 4 at the bottom of which a conduit ensures the transfer of paint axially from the cylinder into the aerosol receptacle.

The frame 5 of the filling station 2 also has, at its base, a bearing surface for the bottom of the aerosol receptacle 4, in the suspended condition of the assembly of cylinder 3 and aerosol receptacle 4 in said frame 5. This bearing surface, adjustable as to position, is constituted by a turnable plate 13 connected to the frame 5 by screwing so as to be raised or lowered in said frame 5 by simple screwing/unscrewing. There is thus obtained, in a certain manner, a permanent contact between the bottom of this aerosol receptacle and the frame.

Figure 5:
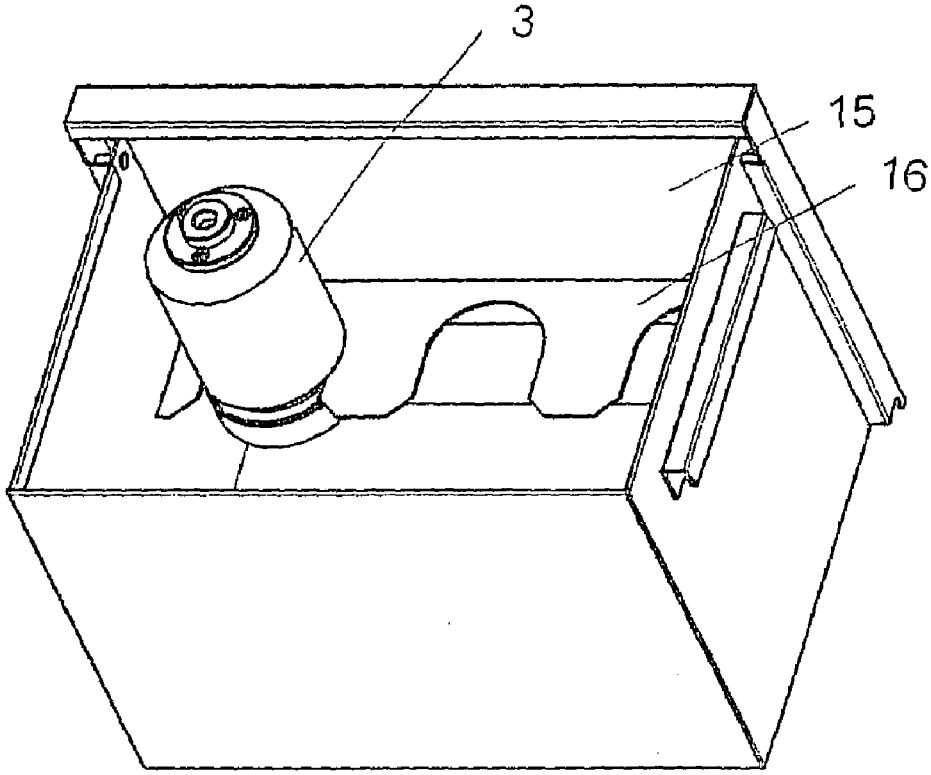
FIG. 5 is a detailed view of the washing enclosure.

In a manner characteristic of the invention, this filling station 2 extends above a washing and drying station 14 of the cylinder or cylinders 3 adapted to be used in the filling station 2. This washing station 14 is thus constituted by at least one reservoir 15 for washing fluid for the cylinders 3 provided, in its upper portion, extending above the maximum level of fluid in the reservoir 15, with means 16 for holding in suspension the cylinder or cylinders so as to ensure their drying by draining. This means 16 for holding in suspension is constituted, as shown in FIG. 5, by a plate 16 provided with semicircular impression of U shape to permit the impression to match the profile of the cylinder 3 at the level of its throat 3A. The maximum level of fluid in the reservoir can itself be identified by a visible marking.

To improve the drying by draining, there can be provided within the reservoir 15 nozzles for flowing air to accelerate drying. There can also be provided accessories aiding in the manual cleaning of the elements, in particular in the form of a brush or the like.

To facilitate the operations of washing by means of such a washing station 14, the reservoir 15 of washing fluid is mounted on the frame 20 of the washing and drying station 14, movably between at least two positions, one of them (FIG. 2) in which the reservoir 15 is open and its content is accessible to the operator, and the other (FIG. 1) in which the reservoir 15 is closed to avoid any dispersal of cleaning fluid into the atmosphere. Thus, in the illustrated examples, this reservoir 15 is in the form of a drawer mounted, preferably removably, on the frame 20 of the washing and drying station 14. The slides for this drawer can be in the form of telescopic elements to avoid the presence of elements projecting from the frame in the closed position of the reservoir 15. This drawer is closed by means of an attached cover.

In the illustrated examples, this drawing containing the cleaning fluid for the cylinders is positioned immediately below the filling station such that the operator has only to open this drawer to be able to take a cylinder which he can then associate with the aerosol receptacle to be filled. Likewise, once the filling operation is completed, he can open the drawer to proceed to the washing of the cylinder and then suspending it so as to obtain drying of this latter. In this way, there is avoided any dispersal of the cleaning fluid between the washing operation and the drying operation on the one hand, and he can immediately proceed to a new filling operation with the same cylinder and without the risk of dissemination of the cleaning or washing fluid into the rest of the enclosure containing such a filling installation. Moreover, the risk of loss of such cylinders is reduced because these cylinders are stored immediately adjacent the filling station.

In the illustrated examples, the frame 20 of the washing and drying station 14 is in the form of a column whose top defines a table 17 for supporting the frame 15 of the filling station for aerosol receptacles 4. This support table 17 is provided with impressions 18 preferably made by stamping from the plane of the support table 17. These impressions 18 serve for positioning the aerosol receptacle 4 upon bringing it into engagement with the cylinder 3. There is then carried out an operation of filling of the cylinder 3. Thus, the assembly comprised by the association of the cylinder 3 and the aerosol receptacle 4 can be disposed on a scale, not shown, which can also be supported by the table 17 of the support. There can thus be carried out the filling operation of the cylinder 3. Once the cylinder 3 is filled, the assembly of cylinder 3—aerosol receptacle 4 is installed within the cabinet of the filling station 2 and operation of the transfer of the liquid contained in the cylinder 3 in the direction of the aerosol receptacle 4 can begin after closing of the door 9 of the station. Once the operation is completed, the assembly of cylinder 3—aerosol receptacle 4 is removed from the cabinet constituting the frame of the filling station 2, the cylinder is separated from the aerosol receptacle 4 and if desired transferred immediately to the cleaning and drying receptacle when the operation of filling with such a fluid is completed.

Figure 1:
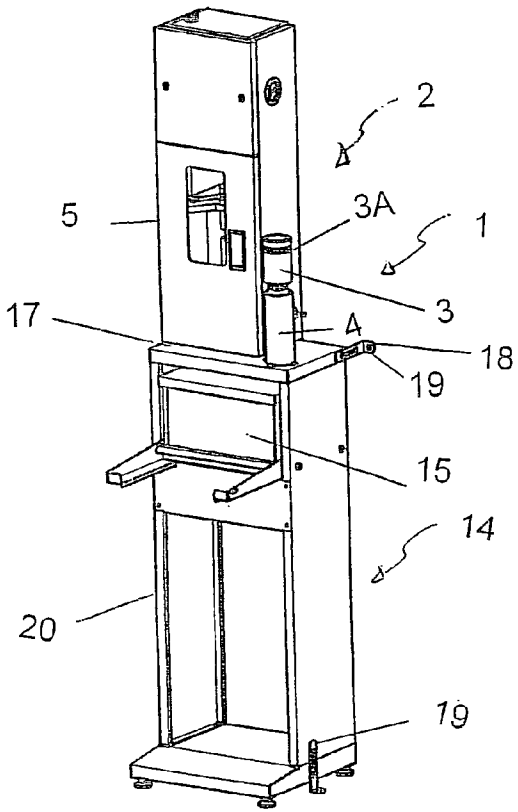
FIG. 1 is a perspective view of a filling installation according to the invention, in which the reservoir of washing fluid is in closed position.
Figure 4:
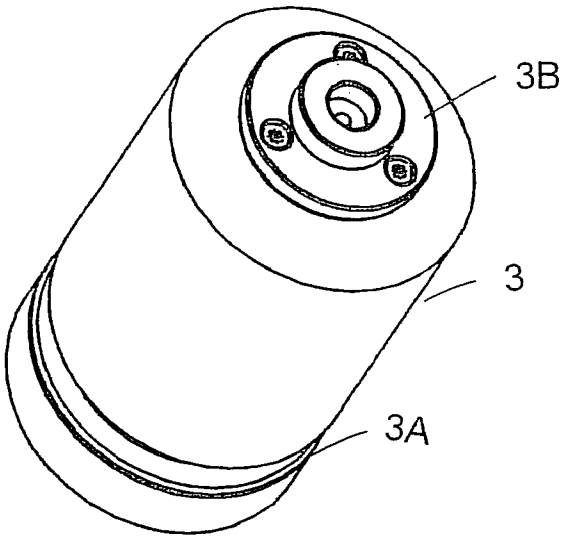
FIG. 4 is a perspective view of the cylinder shown inverted to show the lower portion of this latter adapted to come into engagement with the aerosol receptacle.
Figure 3:
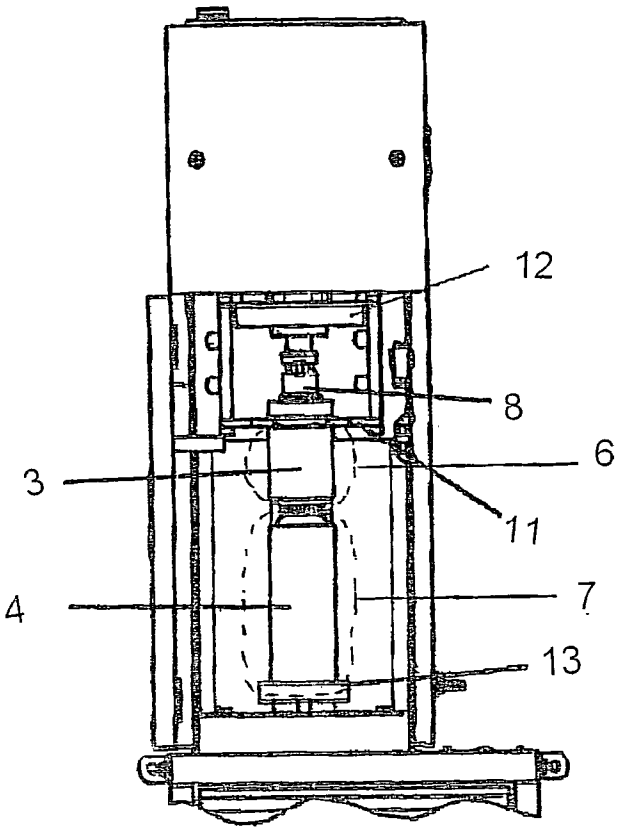
FIG. 3 is a front view of the interior of the filling station.

As shown in FIGS. 1 and 2, the frame 20 of the washing and drying station 14 which has the form of a column which has, in its upper position, the drawer, provides in its lower portion a space which can be used for receiving supplies, such as a can of washing fluid. This column is also provided at its base with feet 22 permitting adjusting the horizontality of the support table 17 of the frame 5.

Moreover, to avoid any tipping over of such an installation, at least one of the frames 5, 20 of the stations 2, 14 for washing and/or filling, has means, such as tongues 19, for securement of the frame 5, 20 to the floor and/or to the wall. Thus, these tongues, as shown, are of L shape of which one of the legs is provided with an oblong opening permitting the securement of the tongue by screwing to the frame. In the illustrated embodiment, it is the frame 20 of the washing station which on the one hand is fixed to the floor by at least one first tongue 19, and on the other hand is fixed to the wall by a second tongue 19 extending to the top of said frame.

What is claimed is:

1. Installation (1) for filling aerosol receptacles (4), of the type comprising a filling station (2) for aerosol receptacles, constituted by a frame (5), at least one cylinder (3), such as a beaker, whose lower portion is adapted to come into engagement with the valve of an aerosol receptacle (4), this cylinder (3) being mounted removably on the frame (5) of the filling station (2), at a position (6) located above the position (7) for reception of the aerosol receptacle (4), by a jack driving a piston (8) with recipricatory movement in the cylinder (3) to cause the liquid contained in the cylinder (3) to pass through the valve of the aerosol receptacle (4) in engagement with said cylinder (3), characterized in that the filling station (2) extends above a washing and drying station (14) for cylinder(s) (3), this washing station (14) being constituted by at least one reservoir (15) of washing fluid provided in its upper portion, extending above the maximum level of fluid in the reservoir (15), with means (16) for holding in suspension the cylinder or cylinders so as to ensure their drying by draining.

2. Installation (1) for filling aerosol receptacles (4) according to claim 1, characterized in that the reservoir (15) for washing fluid is mounted on the frame (20) of the washing and drying station (14) movably between at least two positions, one in which the reservoir (15) is open and its content is accessible to the operator, the other in which the reservoir (15) is closed to avoid any dispersal of cleaning fluid into the atmosphere.

3. Installation (1) for filling aerosol receptacles (4) according to claim 1, characterized in that the reservoir (15) is in the form of a drawer mounted preferably and removably on the frame (20) of the washing and drying station (14).

4. Installation (1) for filling aerosol receptacles (4) according to claim 1, characterized in that the frame (20) of the washing and drying station (14) has the form of a column whose summit defines a support table (17) of the frame (5) of the filling station (2) for aerosol receptacles (4).

5. Installation (1) for filling aerosol receptacles (7) according to claim 4, characterized in that the support table (17) is provided with impressions (18), formed preferably by stamping from the plane of the support table (17), these impressions (18) serving for locating the aerosol receptacle (4) during engagement of the cylinder (3) with said aerosol receptacle (4).

6. Installation (1) for filling aerosol receptacles (4) according to claim 1, characterized in that at least one of the frames (5, 20) of the washing and/or filling stations (2, 14) has means, such as tongues (19), for securement of the frame (5, 20) to the floor and/or to the wall.

7. Installation (1) for filling aerosol receptacles (4) according to claim 1, characterized in that the frame (5) of the filling station (21) has the form of a cabinet containing the cylinder (3) and aerosol receptacle (4) in the suspended condition of the cylinder (3) in said cabinet, this cabinet being provided with a front door (9) having, on its internal surface, a projection (10) holding the cylinder (3) applied against the suspension means of the cabinet, in the closed condition of the door (9) and centering the cylinder (3) relative to the piston (8).

8. Installation (1) for filling aerosol receptacles (4) according to claim 7, characterized in that the suspension means of the cylinder (3) in the frame (5) of the filling station (2) is constituted by a U (12) whose core is secured to the rear surface of the cabinet and by a suspension plate (11) closing one surface of the U (12), this suspension plate (11) comprising a U shaped recess which has legs which insert in an external circumferential throat (3A) of the cylinder (3).

9. Installation (1) for filling aerosol receptacles (4) according to claim 1, characterized in that the frame (5) of the filling station (2) has, at its base, a bearing surface for the bottom of the aerosol receptacle (4), in the mounted condition of the assembly of cylinder (3)—aerosol receptacle (4) in said frame (5), this bearing surface being adjustable in position and being constituted by a turnable plate (13) connected to the frame (5) by screwing to be moved within said frame (5) with a rising or falling movement by simple screwing/unscrewing.

10. Installation (1) for filling aerosol receptacles (4) according to claim 1, characterized in that on the one hand the piston (8) of the frame (5) of the filling station (2) is removably mounted on the rod of the jack to facilitate its cleaning and in that, on the other hand, the lower portion (3B) of the cylinder (3) adapted to come into engagement with the valve of an aerosol receptacle (4) is in the form of a removable member, provided with a bore.

11. Installation (1) for filling aerosol receptacles (4) according to claim 2, characterized in that the reservoir (15) is in the form of a drawer mounted preferably and removably on the frame (20) of the washing and drying station (14).

12. Installation (1) for filling aerosol receptacles (4) according to claim 2, characterized in that the frame (20) of the washing and drying station (14) has the form of a column whose summit defines a support table (17) of the frame (5) of the filling station (2) for aerosol receptacles (4).

13. Installation (1) for filling aerosol receptacles (4) according to claim 3, characterized in that the frame (20) of the washing and drying station (14) has the form of a column whose summit defines a support table (17) of the frame (5) of the filling station (2) for aerosol receptacles (4).

14. Installation (1) for filling aerosol receptacles (4) according to claim 2, characterized in that at least one of the frames (5, 20) of the washing and/or filling stations (2, 14) has means, such as tongues (19), for securement of the frame (5, 20) to the floor and/or to the wall.

15. Installation (1) for filling aerosol receptacles (4) according to claim 3, characterized in that at least one of the frames (5, 20) of the washing and/or filling stations (2, 14) has means, such as tongues (19), for securement of the frame (5, 20) to the floor and/or to the wall.

16. Installation (1) for filling aerosol receptacles (4) according to claim 4, characterized in that at least one of the frames (5, 20) of the washing and/or filling stations (2, 14) has means, such as tongues (19), for securement of the frame (5, 20) to the floor and/or to the wall.

17. Installation (1) for filling aerosol receptacles (4) according to claim 5, characterized in that at least one of the frames (5, 20) of the washing and/or filling stations (2, 14) has means, such as tongues (19), for securement of the frame (5, 20) to the floor and/or to the wall.

18. Installation (1) for filling aerosol receptacles (4) according to claim 2, characterized in that the frame (5) of the filling station (2) has, at its base, a bearing surface for the bottom of the aerosol receptacle (4), in the mounted condition of the assembly of cylinder (3)—aerosol receptacle (4) in said frame (5), this bearing surface being adjustable in position and being constituted by a turnable plate (13) connected to the frame (5) by screwing to be moved within said frame (5) with a rising or falling movement by simple screwing/unscrewing.

19. Installation (1) for filling aerosol receptacles (4) according to claim 3, characterized in that the frame (5) of the filling station (2) has, at its base, a bearing surface for the bottom of the aerosol receptacle (4), in the mounted condition of the assembly of cylinder (3)—aerosol receptacle (4) in said frame (5), this bearing surface being adjustable in position and being constituted by a turnable plate (13) connected to the frame (5) by screwing to be moved within said frame (5) with a rising or falling movement by simple screwing/unscrewing.

20. Installation (1) for filling aerosol receptacles (4) according to claim 2, characterized in that on the one hand the piston (8) of the frame (5) of the filling station (2) is removably mounted on the rod of the jack to facilitate its cleaning and in that, on the other hand, the lower portion (3B) of the cylinder (3) adapted to come into engagement with the valve of an aerosol receptacle (4) is in the form of a removable member, provided with a bore.

* * * * *